US011326338B2

(12) United States Patent
Al-Sabah et al.

(10) Patent No.: US 11,326,338 B2
(45) Date of Patent: May 10, 2022

(54) STRUCTURAL MEMBER

(71) Applicant: UNIVERSITY COLLEGE DUBLIN, NATIONAL UNIVERSITY OF IRELAND, DUBLIN, Dublin (IE)

(72) Inventors: Salam Al-Sabah, Co. Dublin (IE); Debra Fem Laefer, New York, NY (US)

( * ) Notice: Subject to any disclaimer, the term of this patent is extended or adjusted under 35 U.S.C. 154(b) by 0 days.

(21) Appl. No.: 16/763,696

(22) PCT Filed: Nov. 13, 2018

(86) PCT No.: PCT/EP2018/081121
§ 371 (c)(1),
(2) Date: May 13, 2020

(87) PCT Pub. No.: WO2019/092286
PCT Pub. Date: May 16, 2019

(65) Prior Publication Data

US 2020/0378107 A1 Dec. 3, 2020

(30) Foreign Application Priority Data

Nov. 13, 2017 (GB) ..... 1718744

(51) Int. Cl.
*E04B 1/24* (2006.01)
*E04C 3/04* (2006.01)

(52) U.S. Cl.
CPC ..... *E04B 1/2403* (2013.01); *E04C 3/04* (2013.01); *E04B 2001/2415* (2013.01);
(Continued)

(58) Field of Classification Search
CPC ..... E04B 1/2403; E04B 2001/2415; E04B 2001/2457; E04B 2001/2448; E04C 3/04; E04C 2003/0452
See application file for complete search history.

(56) References Cited

U.S. PATENT DOCUMENTS 1,662,728 A * 3/1928 Wait ..... E04B 1/2403 403/173
1,662,729 A * 3/1928 Wait ..... E04B 1/2403 403/263
(Continued)

FOREIGN PATENT DOCUMENTS

DE 29518886 U1 * 2/1996 ..... E04B 1/2403
GB 779411 A * 7/1957 ..... E01D 15/133
(Continued)

OTHER PUBLICATIONS

Machine translation of foreign reference JP 03-093931, obtained from https://www.j-platpat.inpit.go.jp/p0200 (last accessed on Feb. 9, 2021 (Year: 2021).*
(Continued)

*Primary Examiner* — Theodore V Adamos
(74) *Attorney, Agent, or Firm* — Riverside Law LLP

(57) ABSTRACT

A structural assembly (10) comprising a first structural member (100), a second structural member (200), and a lock plate (300). Each of the structural members (100, 200) have a first portion (102, 202) which extends in a first plane and a second portion (103, 203) which extends away from the first portion (102, 202) and which extends in a second plane at an angle to the first plane. The first portion (102, 202) of the structural members (100, 200) are provided with an engagement feature (104, 204) configured to interlock with a compatible engagement feature (304) provided on the lock plate (300) of the structural assembly. The second portion (103, 203) of the first structural member (100) and second structural member (200) being provided with: compatible seating features (106, 206) configured to seat one of the structural members (200) on the other structural member (100).

19 Claims, 15 Drawing Sheets

(52) U.S. Cl.
CPC ..... *E04B 2001/2448* (2013.01); *E04B 2001/2457* (2013.01); *E04C 2003/0452* (2013.01)

(56) References Cited

U.S. PATENT DOCUMENTS 1,662,767 A * 3/1928 Wait ..... E04B 1/2403 403/173
1,662,768 A * 3/1928 Wait ..... E04B 1/2403 403/263
1,662,769 A * 3/1928 Wait ..... E04B 1/2403 403/171
1,688,949 A * 10/1928 Wait ..... E04B 1/2403 403/173
2,291,014 A * 7/1942 Woody ..... E04B 1/5812 403/13
3,664,077 A * 5/1972 Arnold ..... E04B 1/185 52/283
4,091,594 A * 5/1978 Yamashita ..... E04B 1/2403 52/283
5,244,300 A * 9/1993 Perreira ..... E04B 1/2403 403/381
2014/0083042 A1* 3/2014 Hiragaki ..... F16B 7/182 52/655.1
2015/0167299 A1* 6/2015 Trubnikow ..... E04B 1/2403 52/848
2016/0002910 A1* 1/2016 Green ..... F16B 7/042 52/848
2017/0096895 A1* 4/2017 Bonomi ..... E21D 11/24
2018/0002914 A1* 1/2018 Lee ..... E04B 1/2403
2018/0058067 A1* 3/2018 Lake ..... E04C 3/06
2018/0245329 A1* 8/2018 Yu ..... E04B 1/2403
2019/0257071 A1* 8/2019 Green ..... E04B 1/2403
2019/0292783 A1* 9/2019 Pryor ..... E04C 3/38

FOREIGN PATENT DOCUMENTS

JP 03093931 A * 4/1991
JP 2962953 10/1999
WO WO-2016141406 A1 * 9/2016 ..... E04B 1/2403

OTHER PUBLICATIONS

Machine tranlsation of foreign reference JP 2962953, obtained from https://www.j-platpat.inpit.go.jp/p0200 (last accessed on Apr. 28, 2021) (Year: 2021).

* cited by examiner

Section 1-1

STRUCTURAL MEMBER

CROSS-REFERENCE TO RELATED APPLICATIONS

This application is the U.S. national phase application filed under 35 U.S.C. § 371 claiming benefit to International Patent Application No. PCT/EP2018/081121 filed Nov. 13, 2018, which is entitled to priority to GB Patent Application No. 1718744.4, filed Nov. 13, 2017, the contents of each of which are each incorporated by reference herein in their entirety.

The present disclosure relates to a structural member.

In particular, the disclosure is concerned with a structural member for a structural assembly.

BACKGROUND

In many industries, such as the construction industry, there is a need to connect different parts together. A prominent example in the construction industry is the need to connect steel beams to steel columns. In this case, bolts or welds or rivets are used to connect the parts. This requires special connection features. For steel, the process of welding, bolting or riveting is presently necessary, involving many manual operations that must be conducted by a skilled worker. Additionally, the quality of the joint is not guaranteed, as site conditions are often less than ideal for this type of work due to bad weather or accessibility issues.

Subsequent disassembly, where required, may be even more difficult and labour intensive, as it involves breaking or undoing the connections made during assembly. Even for bolted or riveted connections, disassembly may be complicated by corrosion. Disassembly may also cause damage to the connected members, thereby making them unusable without truncating and refabricating their ends.

Hence a means for simply connecting and disconnecting members, which also allows for a safe and reliable connection to make a robust structure, is highly desirable.

SUMMARY

According to the present disclosure there is provided an apparatus as set forth in the appended claims. Other features of the invention will be apparent from the dependent claims, and the description which follows.

Accordingly there may be provided a structural assembly (10) comprising a first structural member (100), a second structural member (200), and a lock plate (300).

Each of the first structural member (100) and second structural member (200) may have a first portion (102, 202) which extends in a first plane, a second portion (103, 203) which extends away from the first portion (102, 202) and which extends in a second plane at an angle to the first plane. The first portion (102, 202) of the first structural member (100) and second structural member (200) may be provided with an engagement feature (104, 204) configured to interlock with a compatible engagement feature (304) provided on the lock plate (300) of the structural assembly. The second portion (103, 203) of the first structural member (100) and second structural member (200) may be provided with compatible seating features (106, 206) configured to seat one of the structural members (200) on the other structural member (100).

The engagement feature (104, 204) of each structural member (100, 200) may be provided as a tooth member (150, 250) which extends from a side of the first portion (102, 202). The engagement feature (304) of the lock plate (300) may comprise a first structural member aperture (350) and a second structural member aperture (352) for receiving tooth members (150, 250) of respective structural members (100, 200) such that the structural members (100, 200) are prevented from moving relative to each other in the first plane.

The tooth member (150, 250) may extend at an angle away from the side of the first portion (102, 202) in a direction away from a proximate end (107, 207) of its respective structural member (100, 200).

The tooth member (150, 250) may taper as it extends away from the side of the first portion (102, 202).

A plurality of tooth members (150, 250) may be provided in series at one end of the first portion (102, 202) of each of the structural members (100, 200).

Each structural member (100, 200) may comprise a third portion (160, 260) which extends from the second portion (103, 203) in a third plane. The third portion (160) of the first structural member (100) and the third portion (260) of the second structural member (200) may be provided with an engagement feature (164, 264) provided as a tooth member (166, 266) configured to interlock with a compatible engagement feature (304) provided on the lock plate (300). The respective engagement feature (304) of the lock plate (300) may comprise further apertures (350, 352) for receiving the third portion tooth members (150, 250) of each structural member (100, 200) such that the lock plate (300) extends between the first portion (102, 202) and third portion (160, 260) of each of the structural members (100, 200).

The compatible seating features (106, 206) may comprise a series of compatible interlocking fingers (110, 210).

The seating features (106, 206) of each structural member (100, 200) may each comprise a seating land (130, 230) compatible with the seating land (130, 230) on the other structural member (100, 200).

The seating land (130, 230) may be provided on a step (132, 232), the step (132, 232) extending in a direction (C-D) of the second plane, and the step being offset from the first plane.

The seating feature (106, 206) of each structural member (100, 200) may comprise a series of stepped seating lands (130, 230) which seat a compatible series of stepped lands (130, 230) on the other structural member (100, 200).

The second portion (103, 203) of each structural member (100, 200) may comprise a locking feature (140, 240) configured to prevent the seating features (106, 206) of the structural members from becoming disengaged by moving past each other in the direction of the second plane.

The locking feature (140) may comprise a locking slot (142, 242) in the second portion (103, 203) for receiving a locking element (500) configured to extend between the structural member locking slots (142, 242) in each structural member.

The locking slots (142, 242) may be provided between the seating lands (130, 230).

The first portion (102, 202) of the first structural member (100) and second structural member (200) may be provided with an end locking feature (108, 208) for locking engagement with each other to thereby prevent the end locking features (108, 208) from becoming disengaged by moving past each other in the first plane, and configured such that the seating features (106, 206) on the second portion (103, 203) of the first structural member (100) and second structural member (200) prevent the end locking engagement features (108, 208) from becoming disengaged by moving past each other of the second plane.

The structural member end locking features (108, 208) may comprise a tooth member (120, 220) which extends away from an end of the first portion (102, 202) of one of the structural members (100, 200) for interlocking engagement with a compatible slot (122, 222) in the end of the first portion (102, 202) of the other of the structural members (100, 200).

The end locking features (108, 208) may comprise a compatible slot (122, 222) for interlocking engagement with a key member (400).

The end locking features (108) on the first structural member (100) may be engageable with the compatible end locking feature (208) provided on the second structural member (200) in the first direction (C-D) of the second plane. The seating features (106) on the first structural member (100) may be engageable with the compatible seating feature (206) provided on the second structural member (200) in the first direction (C-D) of the second plane.

The first plane may be at right angles to the second plane.

There may also be provided a first structural member (100, 200) for a structural assembly (10), the first structural member configured for engagement with a second structural member (200) via a lock plate (300). The first structural member (100) may have a first portion (102) which extends in a first plane, a second portion (103) which extends away from the first portion (102) and which extends in a second plane at an angle to the first plane. The first portion (102) of the first structural member (100) may be provided with an engagement feature (104) configured to interlock with a compatible engagement feature (304) provided on the lock plate (300). The second portion (103) of the first structural member (100) may be provided with seating features (106) configured to seat compatible seating features (206) of the second structural member (200) to seat one of the structural members (200) on the other structural member (100).

Hence there is provided a reliable and repeatable means for rapidly connecting and disconnecting structural members in an assembly. The joining features provide positive engagement, allow for easy connection during assembly and easy disconnection during disassembly.

Members provided with such joining features may be utilised in all load and non-load carrying connections between members such as those in building structures, scaffolding, temporary or dismountable structures, modular construction, furniture, toys and sports equipment.

BRIEF DESCRIPTION OF THE DRAWINGS

Examples of the present disclosure will now be described with reference to the accompanying drawings, in which:

FIG. 4 shows a perspective view of the structural assembly of FIGS. 1, 2 and 3;

DETAILED DESCRIPTION

Figure 1:
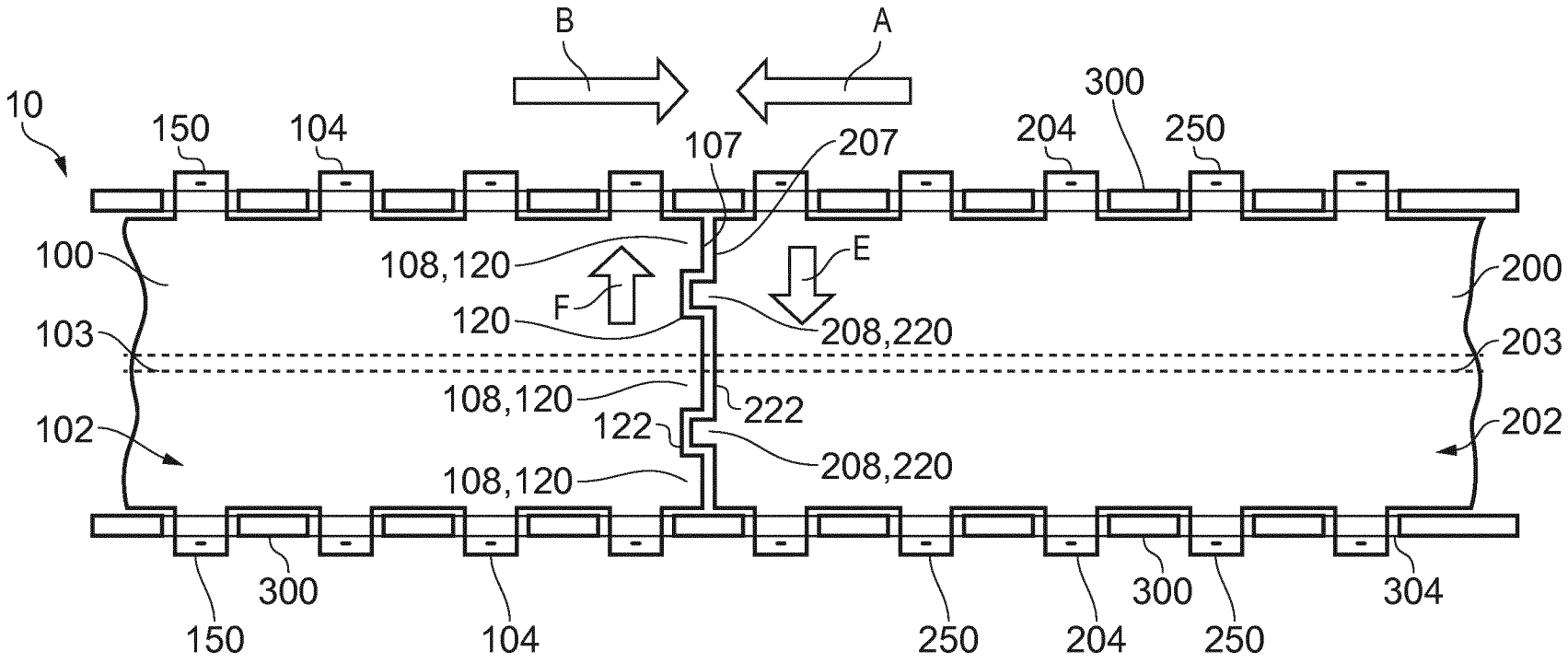
FIGS. 1, 2 and 3 show a plan, side and underside view respectively of a structural assembly according to the present disclosure.
Figure 2:
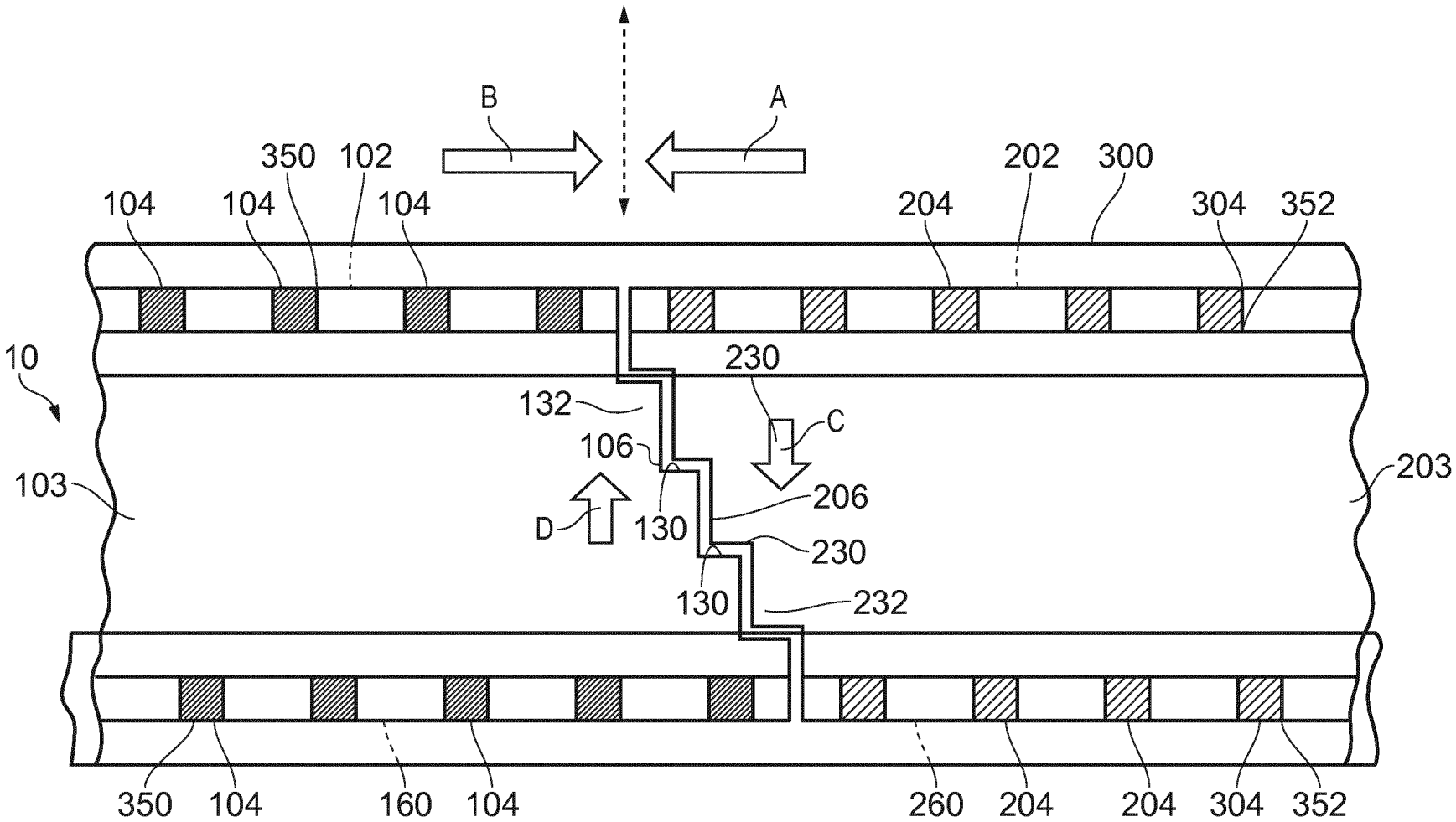
Figure 3:
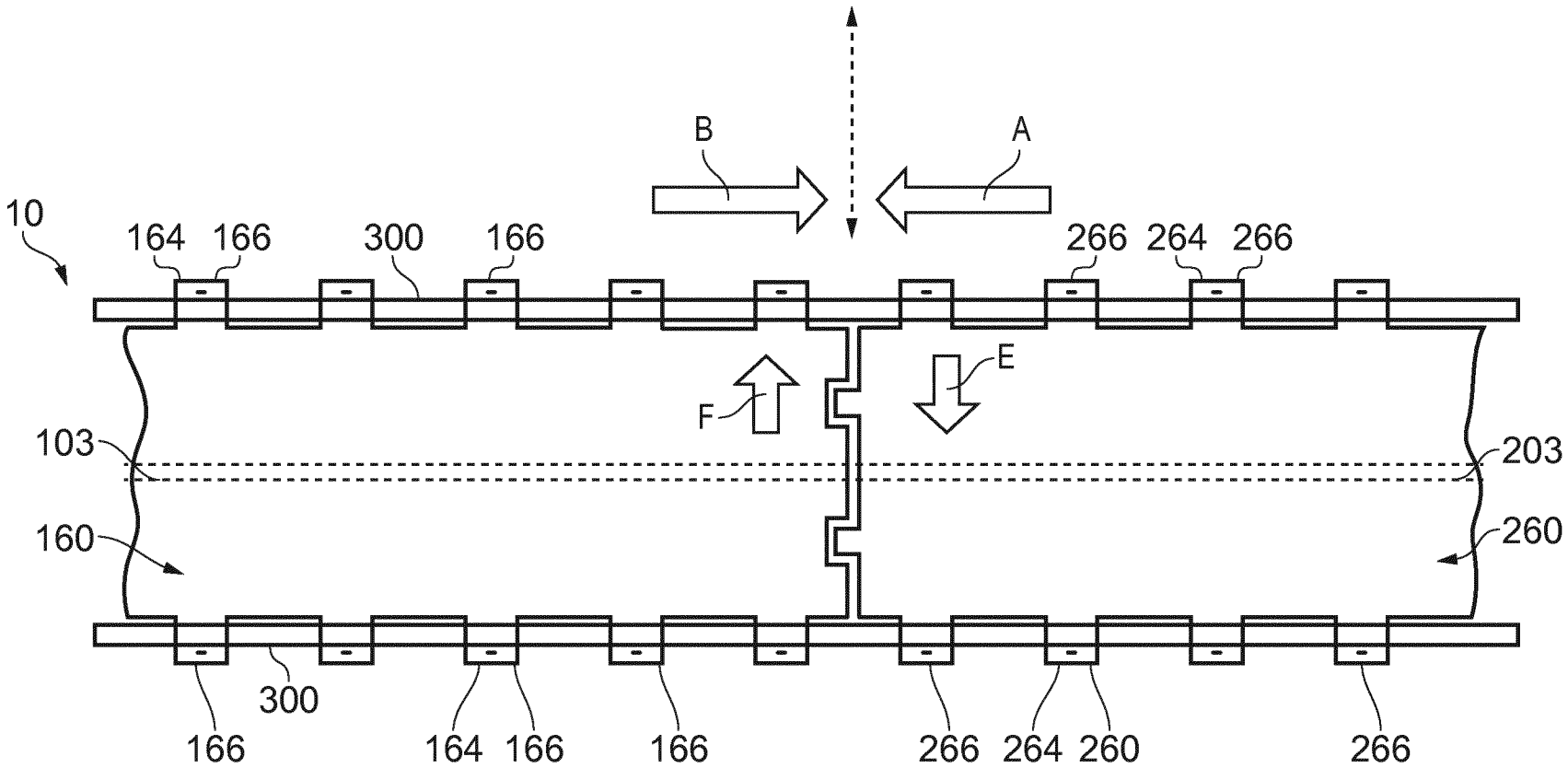

FIGS. 1 to 4 show a first example of a structural assembly 10 according to the present disclosure. FIGS. 1, 3 show a top and underside view respectively, and FIG. 2 shows a side view. FIG. 4 shows a perspective view. For the avoidance of doubt, the same or equivalent features of later examples are referred to using the same reference numerals.

The structural assembly 10 comprises a first structural member 100, a second structural member 200, and a lock plate 300.

Each of the first structural member 100 and second structural member 200 have a first portion 102, 202 (or flange) which extends in a first plane. Put another way, in the FIGS. 1 to 4, the first portion 102, 202 extends a first direction A-B of the first plane which defines the generally longitudinal direction of the structural members 100, 200.

Each of the first structural member 100 and second structural member 200 also have a second portion 103, 203 (or web) which extends away from the first portion 102, 202 and which extends in a first direction C-D of a second plane, the second plane being at an angle to the first plane.

In the examples shown, the first plane is at right angles to the second plane. However, the first plane may be at a different angle to the second plane.

The first portion 102, 202 extends to either side of the second portion 103, 203 in a second (i.e. transverse) direction E-F of the first plane.

Hence the first direction A-B and second direction C-D extend at an angle to one another in the same plane.

Each structural member 100, 200 may also be provided with a third portion 160, 260.

Hence the structural members 100, 200 may thus be provided as "I" beams (alternatively known as "H" beams, Universal Beams (U B), or Rolled Steel Joist (RSJ), although also identifiable by other descriptions) with the first portion 102, 202 and third portions 160, 260 providing the tops and bottom of the "I", and the second portion 103, 203 providing the span between the top and bottom of the "I". The third portion 160, 260 may be identical in most respects to the first portion 102, 202. Hence where the first portion 102, 202 is described, this description applies equally well to features of the third portion 160, 260.

In alternative examples the structural member may be provided as a "T" beam with only a first portion 102, 202 and second portion 103, 203.

The structural members herein described may comprise parts of "I" and "T" beams, which may form part of a building or scaffolding, for example. Alternatively, the structural members may be provided as the joining features of other structures, for example the joining features of wall elements of pre-fabricated buildings, parts of self-assembly furniture, constructional toys, sports equipment (e.g. goals erected for temporary use and then dismantled for storage), temporary fencing (for example for use as crowd safely measures), staging equipment to hold lighting and sound equipment for performances.

The first portion 102, 202 of each of the first structural member 100 and second structural member 200 is provided with an engagement feature 104, 204 configured to interlock with a compatible engagement feature 304 provided on the lock plate 300.

The engagement feature 104, 204 of each structural member 100, 200 is provided as a tooth member (or "finger") 150, 250 which extends from a side edge of the first portion 102, 202. That is to say each structural member 100, 200 has longitudinal end faces (or ends) 107, 207 which (in the example of FIGS. 1 to 4) when assembled, face one another, and the engagement features 104, 204 (tooth members/fingers 150, 250) extend in the same plane as the first portion 102, 202, but extend from the side edges of the structural members 100, 200 in the transverse second direction E-F of the first plane relative to the longitudinal first direction A-B of the first plane. Put another way, the engagement features 104, 204, (tooth members 150, 250) extend in a generally transverse direction second direction E-F of the first plane of each structural member.

The engagement features 304 of the lock plate 300 comprises a first structural member aperture 350 for receiving tooth members 150 of the first structural member 100, and a second structural member aperture 352 for receiving tooth members 250 of the second structural member 200.

The first structural member aperture 350 and second structural member aperture 352 are also configured for interlocking engagement with the tooth members 150, 250 such that the structural members 100, 200 are prevented from moving relative to each other in the first direction A-B of the first plane.

As shown in FIGS. 1 to 4, a plurality of tooth members 150, 250 are provided in series toward one end of the first portion 102, 202 of each of the structural members 100, 200.

As described above, in the example shown, each structural member 100, 200 comprises a third portion 160, 260 which extends from the second portion 103, 203 and in a third plane, where the third plane may be parallel to, but offset from, the first plane. The third portion 160, 260 of the first structural member 100 and second structural member 200 is provided with an engagement feature 164, 264 provided as a tooth member 166, 266 configured to interlock with a compatible engagement feature provided on a lock plate 300 which spans between them. The respective engagement feature 304 of the lock plate 300 comprises a further aperture 350 for receiving the third portion tooth members 150, 250 of each structural member 100, 200 such that the lock plate 300 extends between the first portions 102, 202 and third portions 160, 260 of each of the structural members. As described in relation to the first portions 102,202 the third portions 160, 260 may be provided with a plurality of tooth members, and the lock plate with a corresponding number of apertures 350, 352 for receiving the plurality of tooth members of the third portion 160, 260 such that, when engaged, the structural members 100, 200 are prevented from moving relative to each other in the first direction A-B of the first plane.

The second portion 103, 203 of the first structural member 100 and the second structural member 200 are provided with compatible seating features 106, 206 configured to seat one of the structural members 200 on the other structural member 100. The compatible seating features 106, 206 of each structural member 100, 200 each comprise a seating land 130, 230 compatible with the seating land 130, 230 on the other structural member 100, 200. This is best shown in FIG. 2. The seating feature 106, 206 of each structural member 100, 200 may comprise a series of step seating lands 130, 230 which seat a compatible series of stepped lands 130, 230 on the other structural member 100, 200. The seating feature 106 on the first structural member 100 is engageable with the compatible seating feature 206 provided on the second structural member 200 in the first direction C-D of the second plane.

The first portion 102, 202 of the first structural member and second structural member are provided with an end locking feature 108, 208 which extends from end faces 107, 207 respectively for locking engagement with each other.

The structural member end locking features 108, 208 comprise a tooth member 120, 220 which extends away from the end faces 107, 207 of the first portion 102, 202 of one of the structural members 100, 200 for interlocking engagement with (that is to say to be received by) a compatible slot 122, 222 in the end 107, 207 of the first portion 102, 202 of the other of the structural members 100, 200.

The end locking feature 108 on the first structural member 100 is engageable with the compatible end locking feature 208 provided on the second structural member 200 in the first direction C-D of the second plane as shown in FIG. 2.

The end locking feature 108 on the first structural member 100 may also be engageable with the compatible end locking feature 208 provided on the second structural member 200 in the first direction A-B of the first plane as shown in FIG. 2.

The end locking feature 108, 208 is configured such that the end locking features 108, 208 are prevented from becoming disengaged by moving past each other in the second direction E-F of the first plane. The end locking features 108, 208 are also configured such that the seating features 106, 206 on the second portion 103, 203 of the first structural member 100 and second structural member 200 prevent the end locking engagement features 108, 208 from becoming disengaged by moving past each other in the first direction C-D of the second plane.

In the example of FIG. 4, the lock plates 300 are provided as plane/flat plates. As shown in FIG. 4 there is provided a lock plate 300 for each side of the first portion 102, 202 of the structural members. Hence where the structural members are H beams, there are provided four lock plates 300 which are spaced apart from one another.

Figure 5:
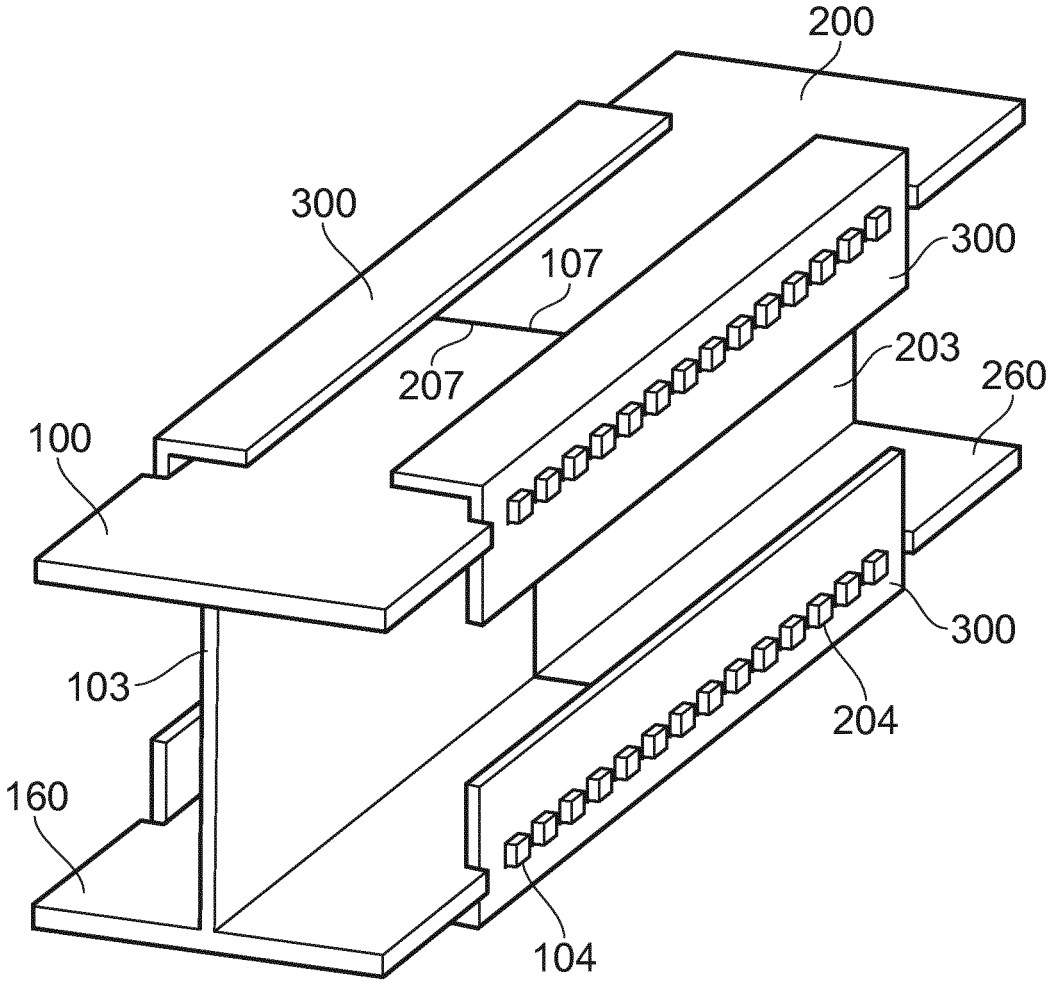
FIG. 5 shows a perspective view of an alternative example of a structural assembly according to the present disclosure.

As shown in FIG. 5, the lock plate 300 may comprise an "L" shaped angle iron, one arm of which comprises the engagement features apertures 350 for the first structural member 100 and engagement feature apertures 352 for the second structural member 200.

Figure 6:
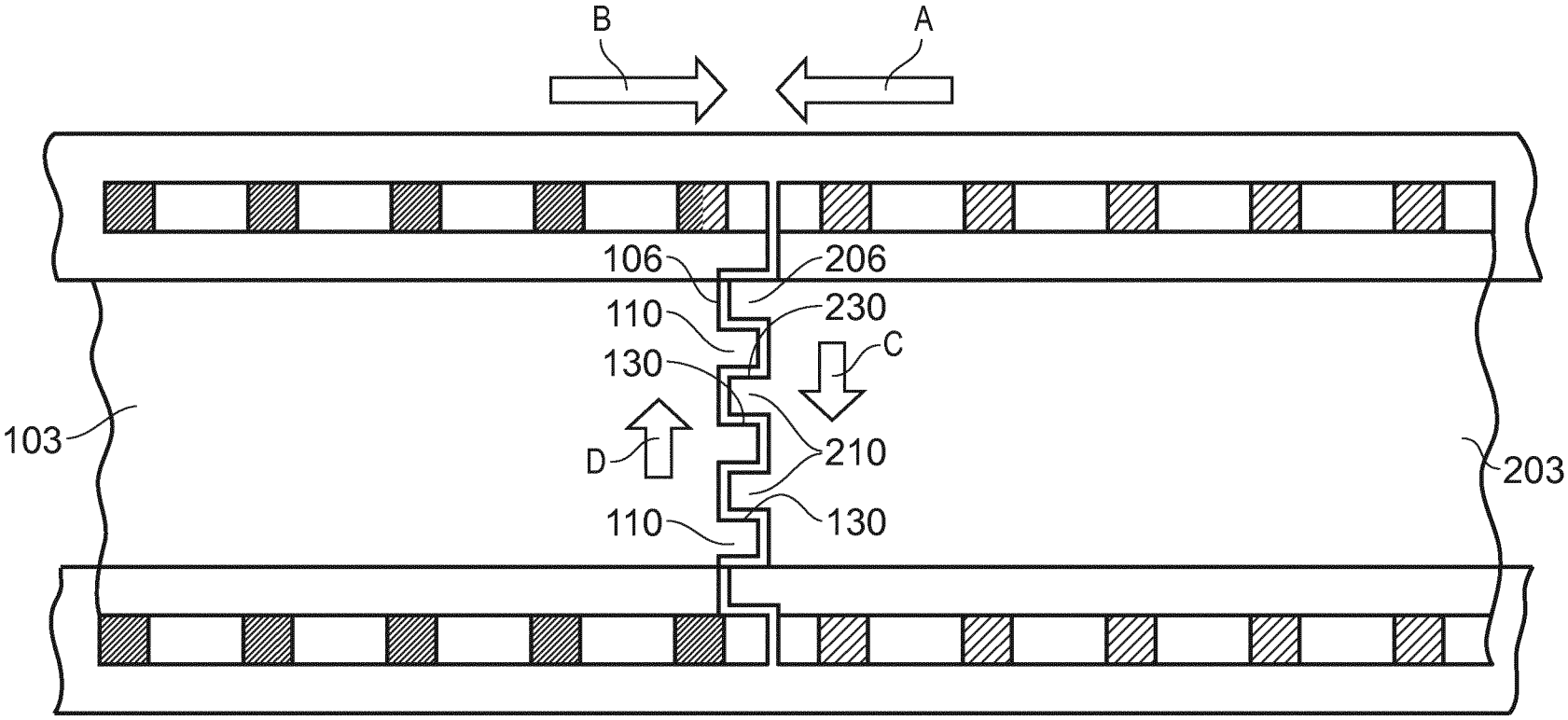
FIG. 6 shows an alternative example of the arrangement shown in FIG. 2.
Figure 7:
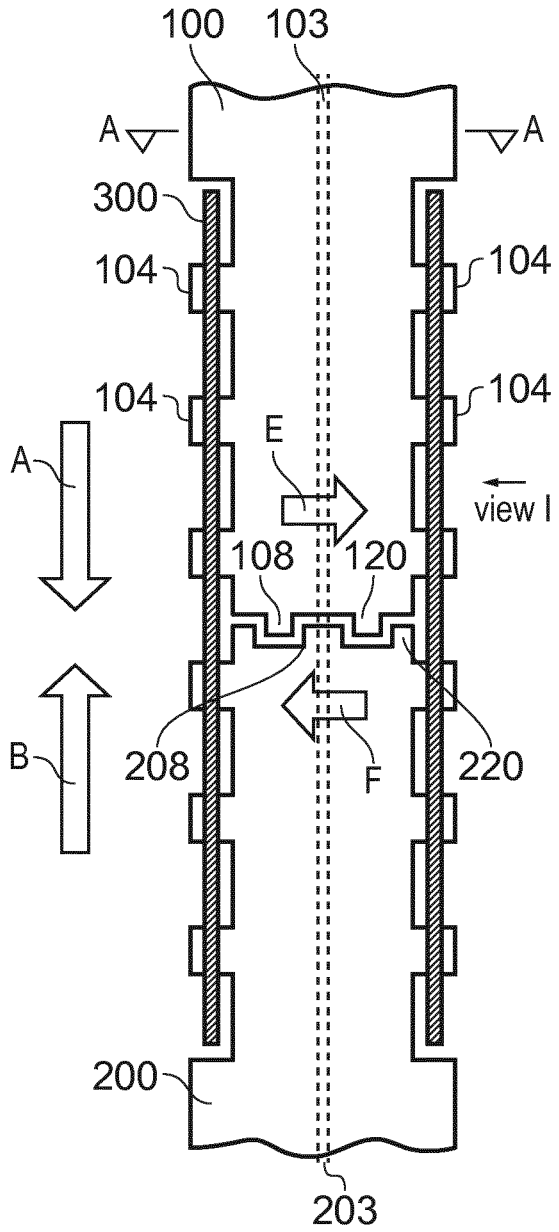
FIGS. 7 to 11 show different views of a further alternative example of a structural assembly according to the present disclosure.
Figure 8:
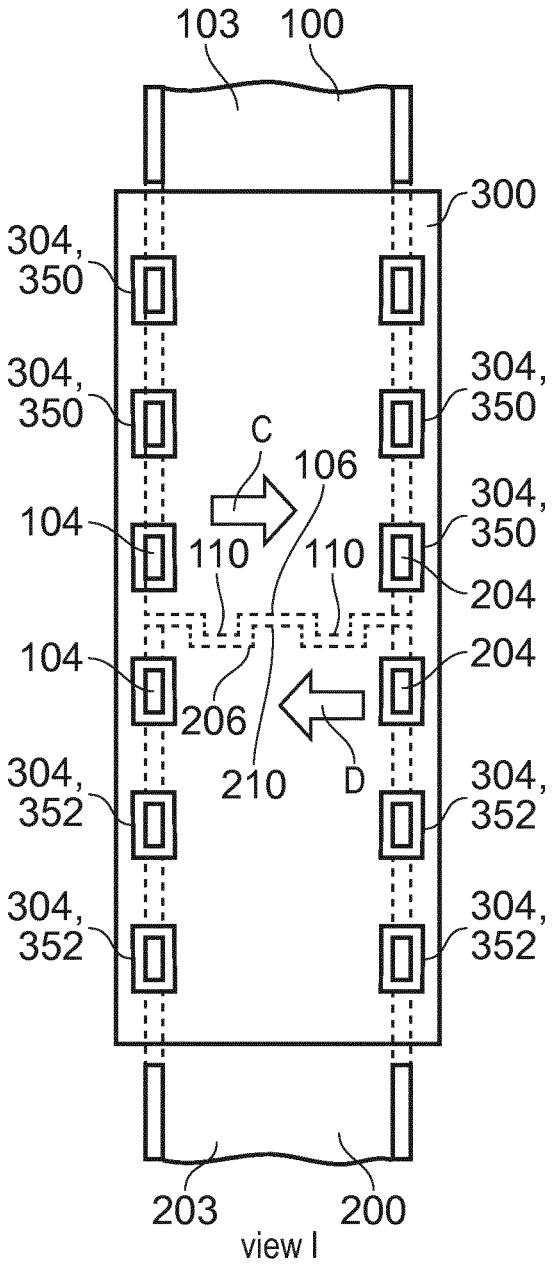
Figure 9:
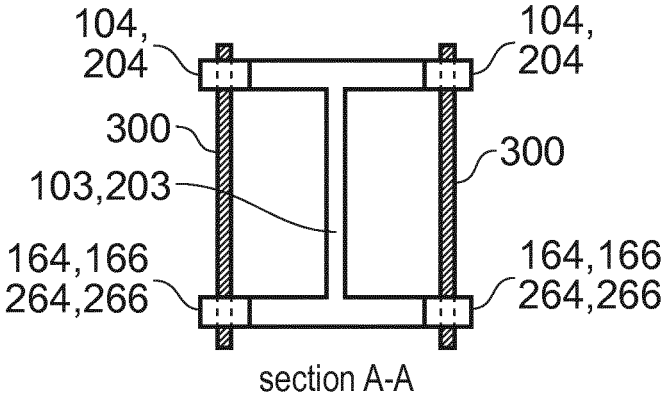
Figure 10:
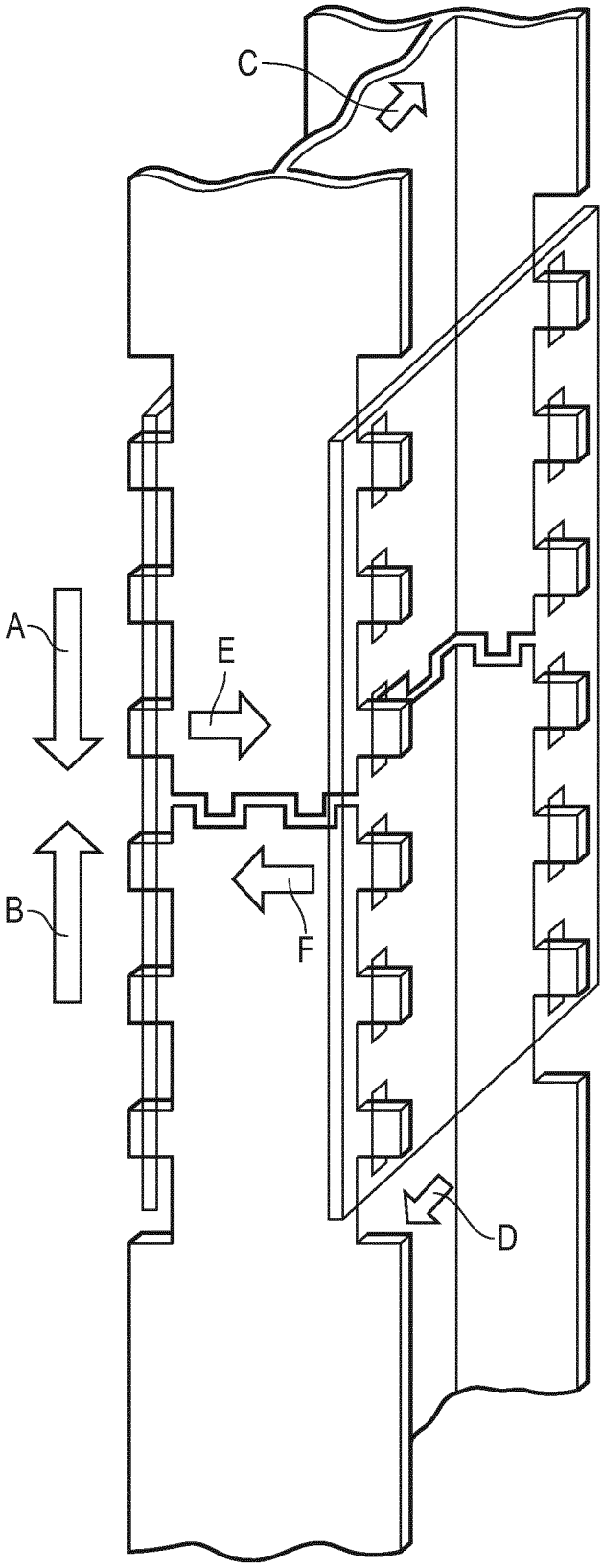
Figure 11:
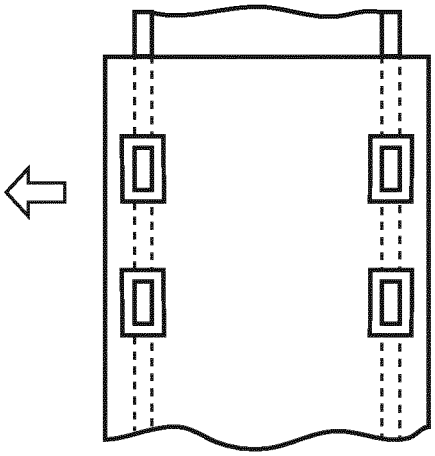

FIG. 6 shows a side view of a structural assembly according to the present disclosure, similar to that shown in FIG. 2. However, in this example the compatible seating features 106, 206 comprise a series of compatible interlocking fingers 110, 210.

Hence in the example of FIG. 6 the compatible seating features 106, 206 which comprise a series of compatible interlocking fingers 110, 210 are configured to prevent the end locking features 108, 208 from becoming disengaged by moving past each other than the first direction C-D of the second plane.

As shown in FIGS. 7 to 11 the lock plate 300 may also be provided as a plate which spans the engagement feature fingers 104, 204 of the first portion 102, 202 and third portion 160, 260. In this example, the respective engagement feature 304 of the lock plate 300 comprises further apertures 350, 352 for receiving the third portion tooth members 166, 266 of each structural member 100, 200. That is to say in the example of FIGS. 7 to 11 the lock plate 300 extends between, and engages with, the flanges of the first portion 102, 202 and third portion 160, 260 of the structural members 100, 200 respectively. Additionally, a lock plate 300 is provided on both sides of the structural member, so that both sides of each flange 102, 202 is connected to the other flange 160, 260 of each structural member.

The example of FIGS. 7 to 11 includes seating features 106, 206 akin to those shown in FIG. 6, comprising interlocking fingers 110, 210, rather than the series of steps as shown in the example of FIG. 2. However, any of the example seating features may be used in any of the examples of the present disclosure.

Figure 12:
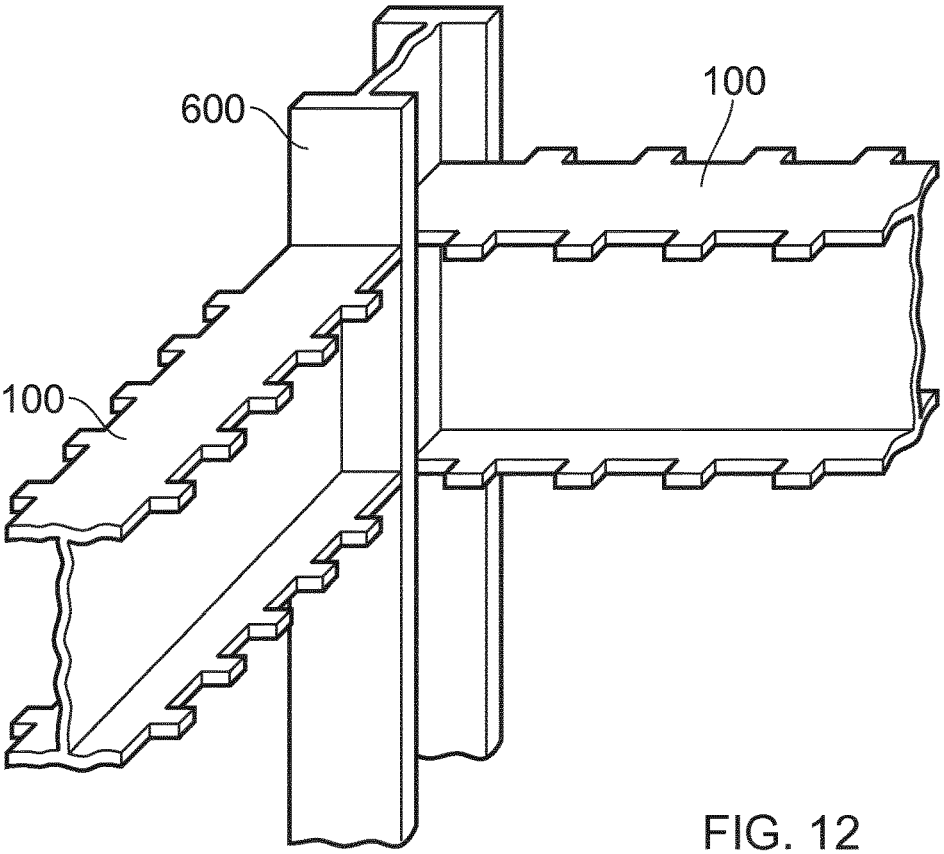
FIG. 12 shows an alternative example of a structural member of a structural assembly according to the present disclosure.

The structural members 100, 200 may extend from other features in a structure being constructed. For example, as shown in FIG. 12, a structural member 100 may extend from a column 600, to which it is attached, for example welded. Hence second structural members 200 can be attached to the first structural members to create other parts of the structural assembly being formed.

Figure 13:
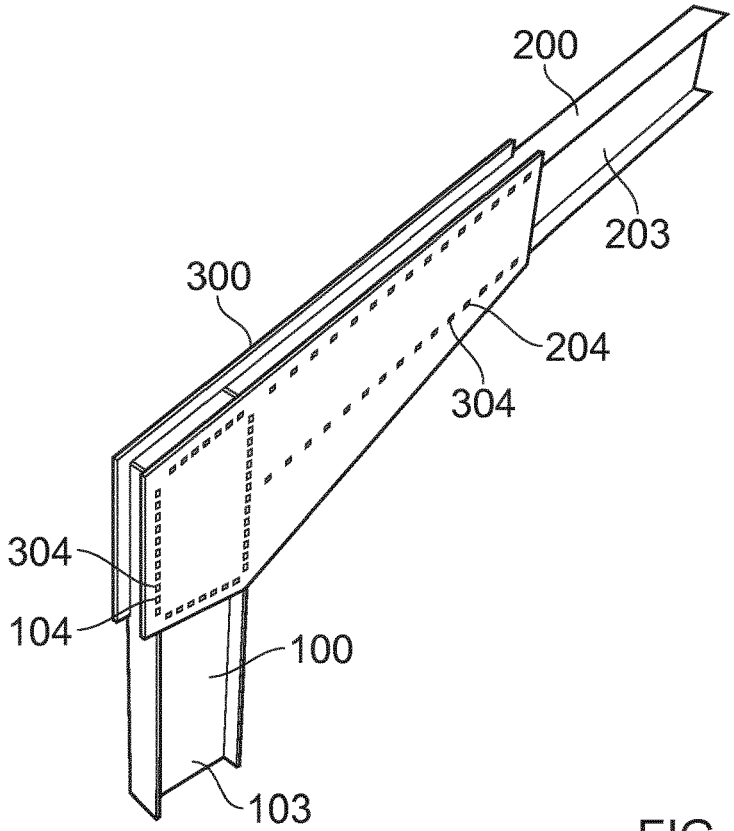
FIG. 13 shows a further alternative example of a structural assembly according to the present disclosure.

FIG. 13 shows another example in which the first structural member 100 and second structural member 200 may be attached at an angle (for example, a right angle) to one another. Hence in this example a pair of lock plates 300 sandwich the first structural member 100 and second structural member 200 at an angle to one another, with engagement features 104, 204 extending from the first portion 102, 202 and third portions 160, 260 of the structural members 100, 200 to engage with compatible engagement apertures 304 provided on the lock plate 300. The second portions 103, 203 of the structural members 100, 200 are provided with compatible seating features (not shown) configured to seat one of the structural members 200 on the other structural member 100.

Figure 14:
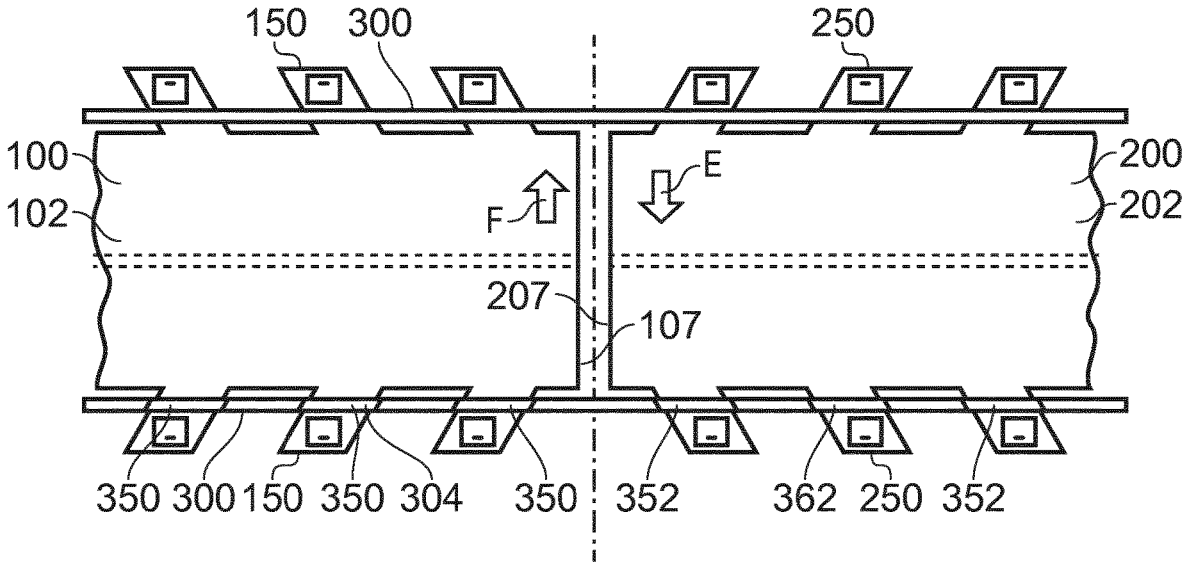
FIGS. 14, 15 show a view of a further alternative example of a structural assembly according to the present disclosure.
Figure 15:
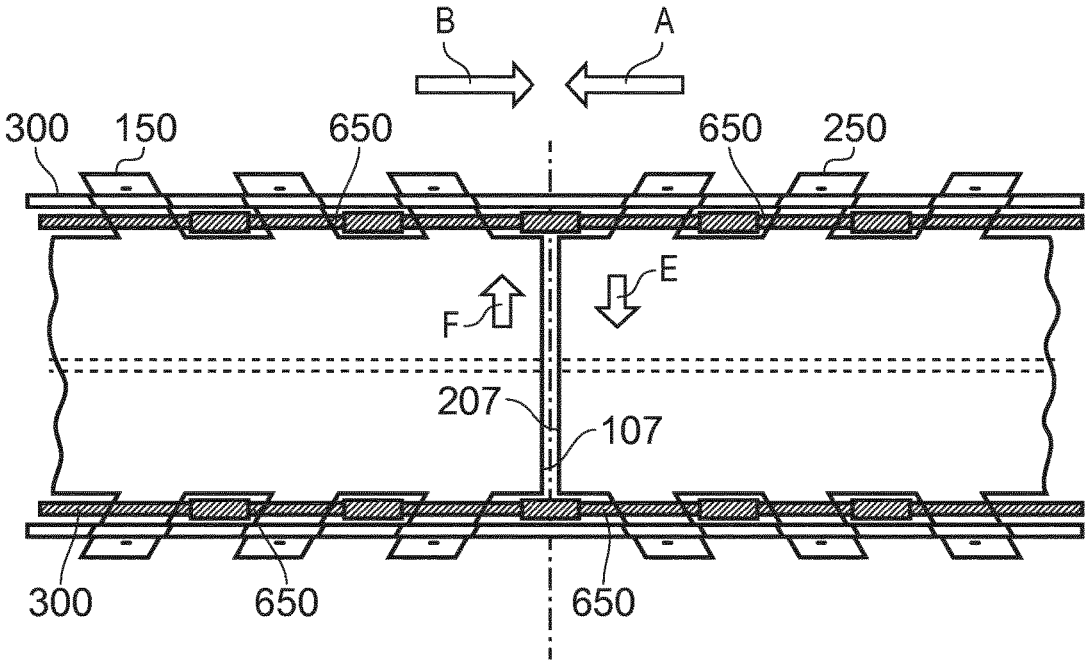

FIGS. 14, 15 show a further alternative example of the structural assembly components of the present disclosure. These views are akin to that shown in FIG. 1.

However, in this example the tooth members 150, 250 extend at an angle away from the side of the first portion 102, 202 in a direction away from the proximate end 107, 207 of its respective structural member 100, 200.

That is to say, in this example the tooth members 150, 250 extend at an angle to the transverse second direction E-F of the first plane in a direction away from the end face 107, 207 of its respective structural member 100, 200.

Figure 16:
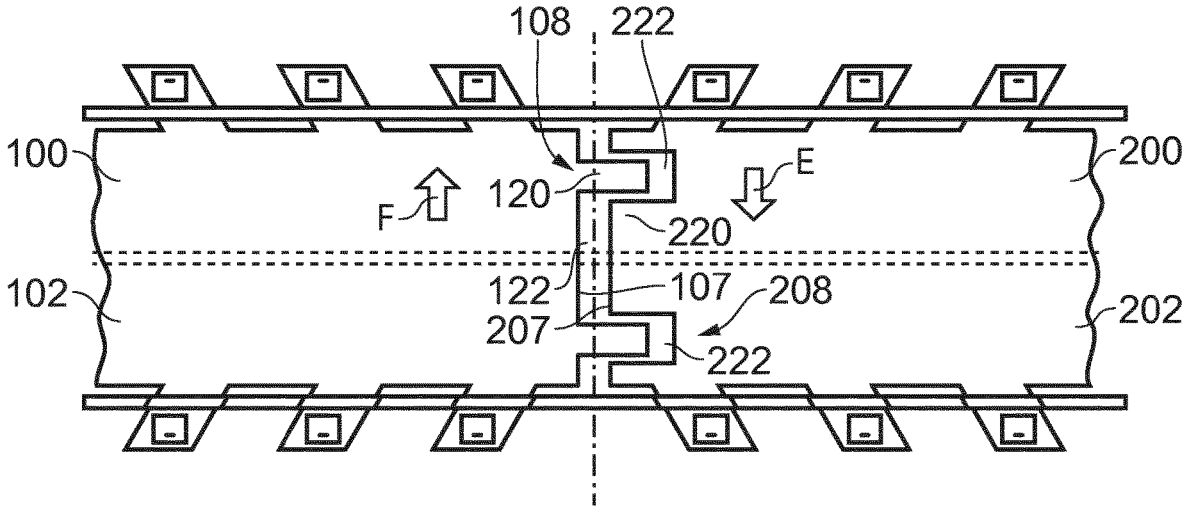
FIGS. 16, 17 show a view of a further alternative example of a structural assembly according to the present disclosure.
Figure 17:
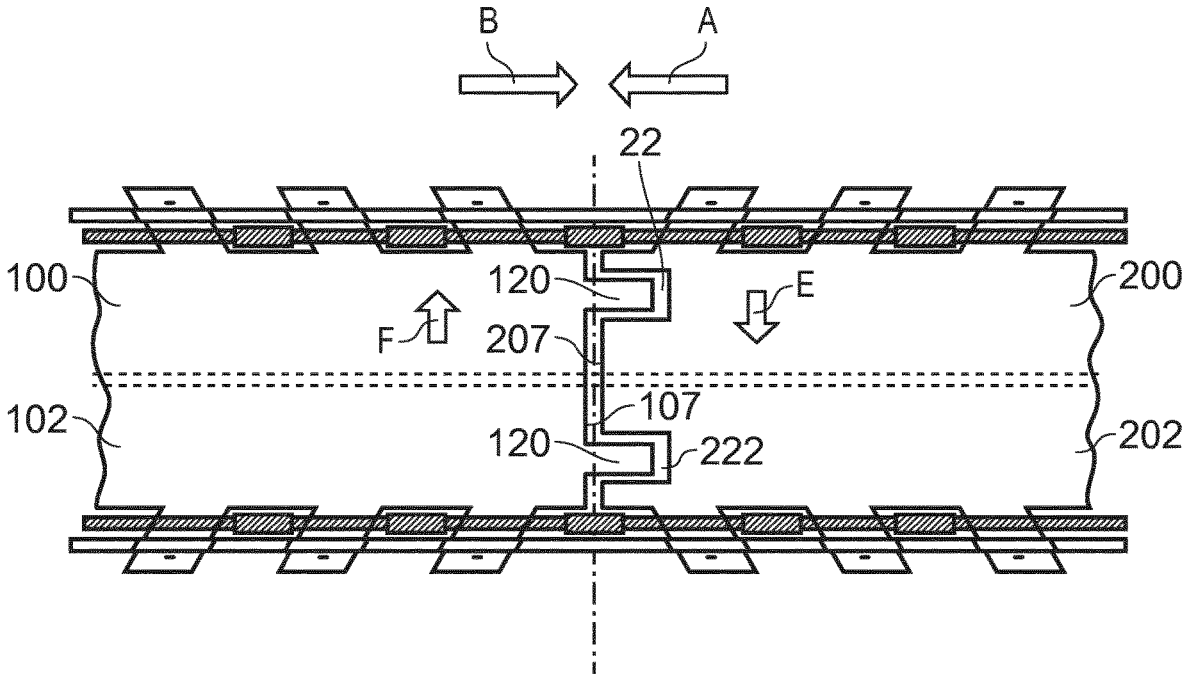
Figure 18:
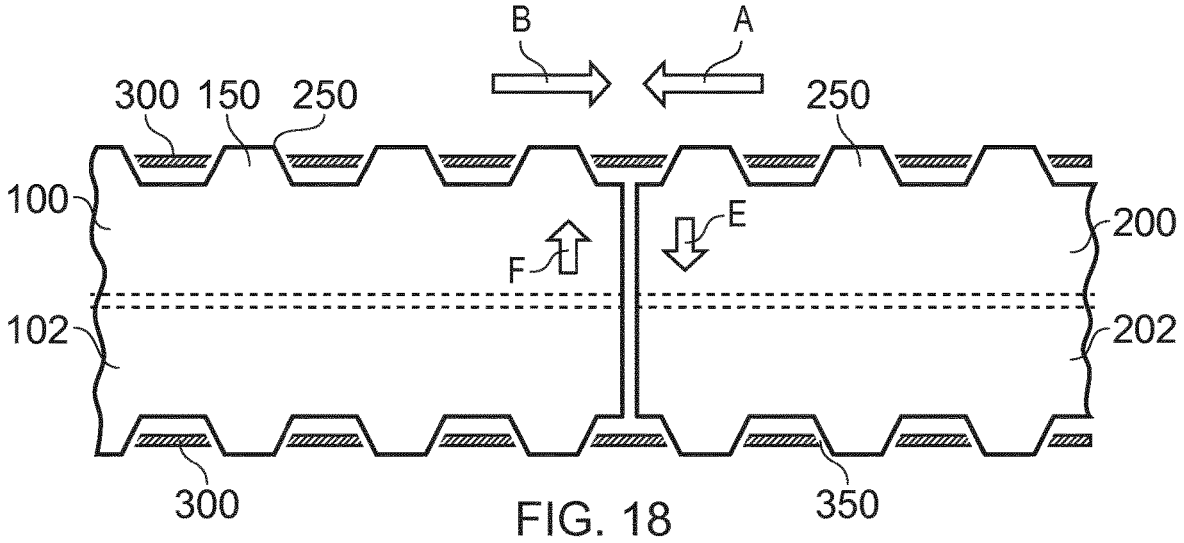
FIG. 18 shows another alternative example of a structural assembly according to the present disclosure.

Also, although end locking features 108, 208 are shown in FIGS. 1, 3, 6, 7, 10, 16, 17 and 19, in the example of FIGS. 14, 15, 18 no end locking features are provided.

Hence the end faces 107, 207 of the examples of 14, 15, 18 are plane, or at least have no engagement features which cooperate with the end face of the opposing structural member.

The example of FIGS. 14, 15 is particularly advantageous as it provides an adjustable structure. The examples shown in FIG. 14, 15 are of the same structure, but with the structural members 100, 200 spaced apart to different extents.

The apertures in the lock plate 300 may be angled in the same direction as the fingers 150, 250. That is to say the apertures 350 in the lock plate 300 for the first structural member are angled in a first direction, and the apertures 352 in the lock plate 300 for the second structural member are angled in a second direction, different to the first direction. Hence the distance between the end faces 107, 207 of the structural members 100, 200 can be controlled by moving the lock plate 300 through different distances along the fingers 150, 250 of the structural members. Hence with the lock plate 300 in a first position, for example as shown in FIG. 14 a first gap is provided between the end faces 107, 207. If a shim 650 is provided between the lock plate 300 and the structural members 100, 200 then the act of forcing the lock plate apertures along the length of the fingers 150, 250 forces the end faces 107, 207 toward each other to form a second gap which is less than the first gap shown in FIG. 14.

In an alternative example, shown in FIGS. 16, 17, end locking features 108, 208 akin to that shown in FIGS. 1, 3, 6, 7, 10 are provided in combination with the tooth member 150, 250 arrangement shown in FIGS. 14, 15. Hence in this example the first portions 102, 202 (and third portions 160, 260 where applicable) are provided with end locking features 108, 208 which extend from their respective end faces 107, 207 for locking engagement with each other. In this example, the length of the end locking features 108, 208 may be chosen in dependence on the distance which the tooth members 150, 250 extend in the first direction A-B of the first plane. That is to say, in such an example, the end locking features 108, 208 have a length which ensures that, even when the members 100, 200 are spaced apart by their maximum extent when the lock plate 300 is in place (for example in FIG. 16) then the end locking features 108, 208 overlap in the first direction A-B of the first plane such that the members 100, 200 may not move relative to one another in the second direction E-F of the first plane.

An alternative arrangement is shown in FIG. 18, which also allows adjustment of the relative spacing of the first structural member 100 and second structural member 200. In this example, the tooth members 150, 250 of each of the structural members taper as they extend away from the side of the first portion 102, 202. That is to say, the tooth members 150, 250 of each of the structural members have the form of a parallelogram, with a free end of the tooth members being the shortest parallel side of the parallelogram. The lock plate 300 has apertures 250, 350 with a frustoconical cross section such that the size of the apertures 250, 350 is larger on one side of the lock plate 300 than on the other side of the lock plate 300. In combination with the tapered fingers 150, 250, as shown in FIG. 18, the height/location of the lock plate 300 along the fingers 150, 250 allow for the relative movement of the structural members 100, 200 in the direction A-B of the first plane.

In the examples of FIGS. 14 to 18 the structural members of the structural assembly may be adjusted relative to one another with these arrangements such that any small gaps between the fingers 150, 250 and the side plate 300 can be closed by simply adjusting the lock plate 300 relative to the flanges 102, 202. This allows for variable adjustability that can be useful in cases where initial site assembly requires a small amount of "play" between the connected structural members 100, 200 until site measurements are made and the final structural member relative position is determined. Once the final geometry is arranged, the lock plates can be pushed into their final position, and then locked in place.

Figure 19:
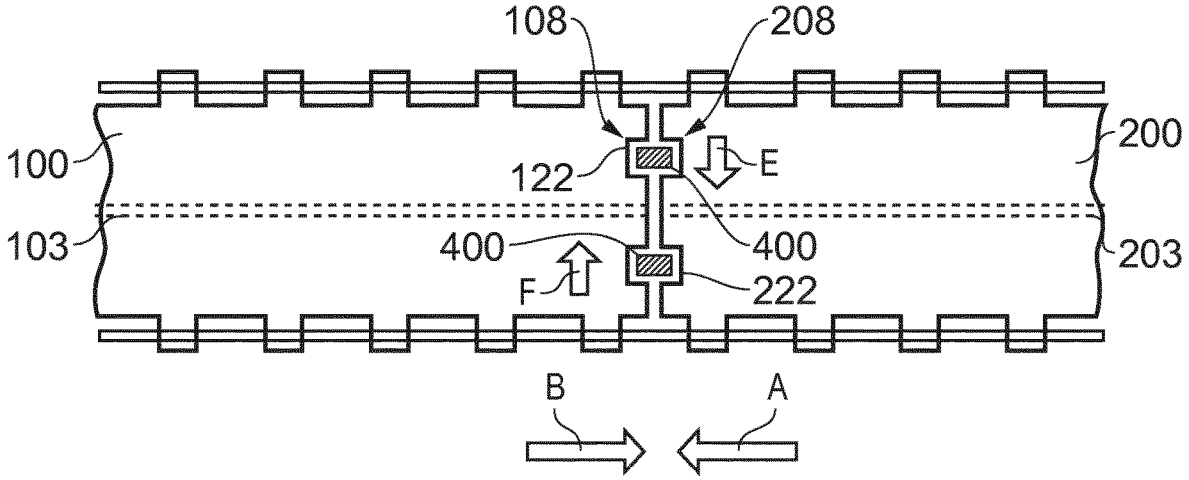
FIG. 19 shows a further alternative example of a structural assembly according to the present disclosure.

FIG. 19 shows a similar view to that shown in FIG. 1, although with an alternative means for locking the first structural member 100 relative to the second structural member 200 in the second direction E-F of the first plane. The end locking features 108, 208 of FIG. 19 comprise a compatible slot 122 for interlocking engagement with a key member 400.

FIGS. 20 to 28 show various examples of locking features configured to keep the lock plate 300 attached to the fingers 150, 250, and hence retain the lock plate 300 in place to ensure the structural members 100, 200 remain attached.

Figure 20:
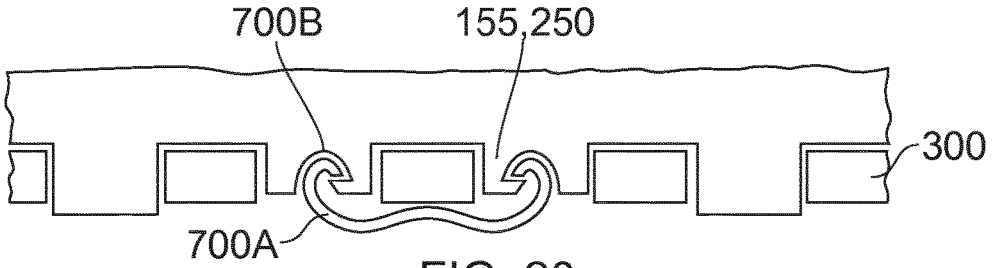
FIGS. 20, 21 show different views of a locking arrangement which forms part of the structural assembly according to the present disclosure.
Figure 21:
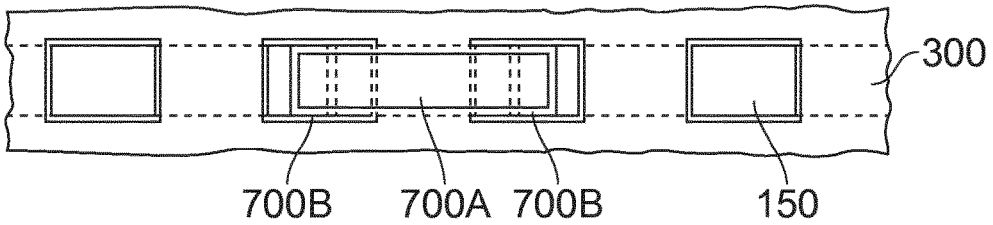

In FIGS. 20, 21 a locking feature is provided as a spring lock plate 700A which is received in a recess 700B provided in a pair of adjacent fingers 150, 250. Hence the spring lock plate 700A when pushed into the recess 700B urges the lock plate 300 towards the corresponding structural member 100, 200.

Figure 22:
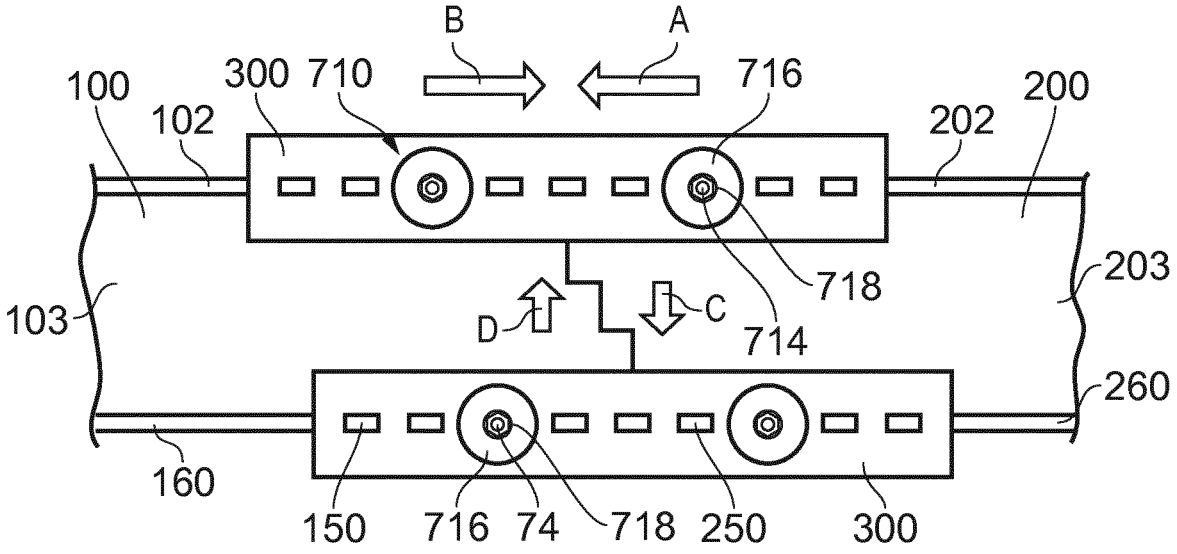
FIGS. 22, 23 show an alternative locking arrangement for a structural assembly according to the present disclosure.
Figure 23:
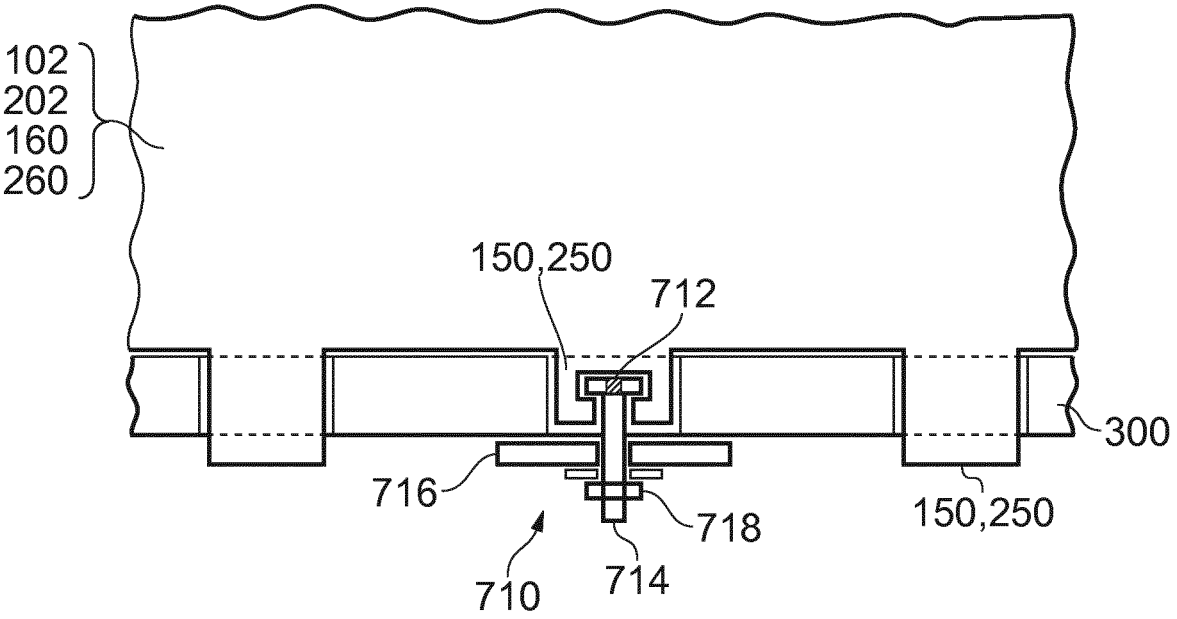

In the example shown in FIGS. 22, 23 a locking feature 710 comprises a locking slot 712 in the fingers 150, 250 for receiving a locking element (e.g. a bolt) 714 which extends out of the finger 150, 250 to pass through a washer 716 (or other plate) and then a fixing means (for example a nut) 718 is tightened against the washer 716 to hold the arrangement in place and urge the lock plate 300 towards the first portion 102, 202 of each of the structural members. In this way the arrangement is very similar to that of FIG. 20, except using a bolt and slot and washer as opposed to a spring lock plate and recess.

Figure 24:
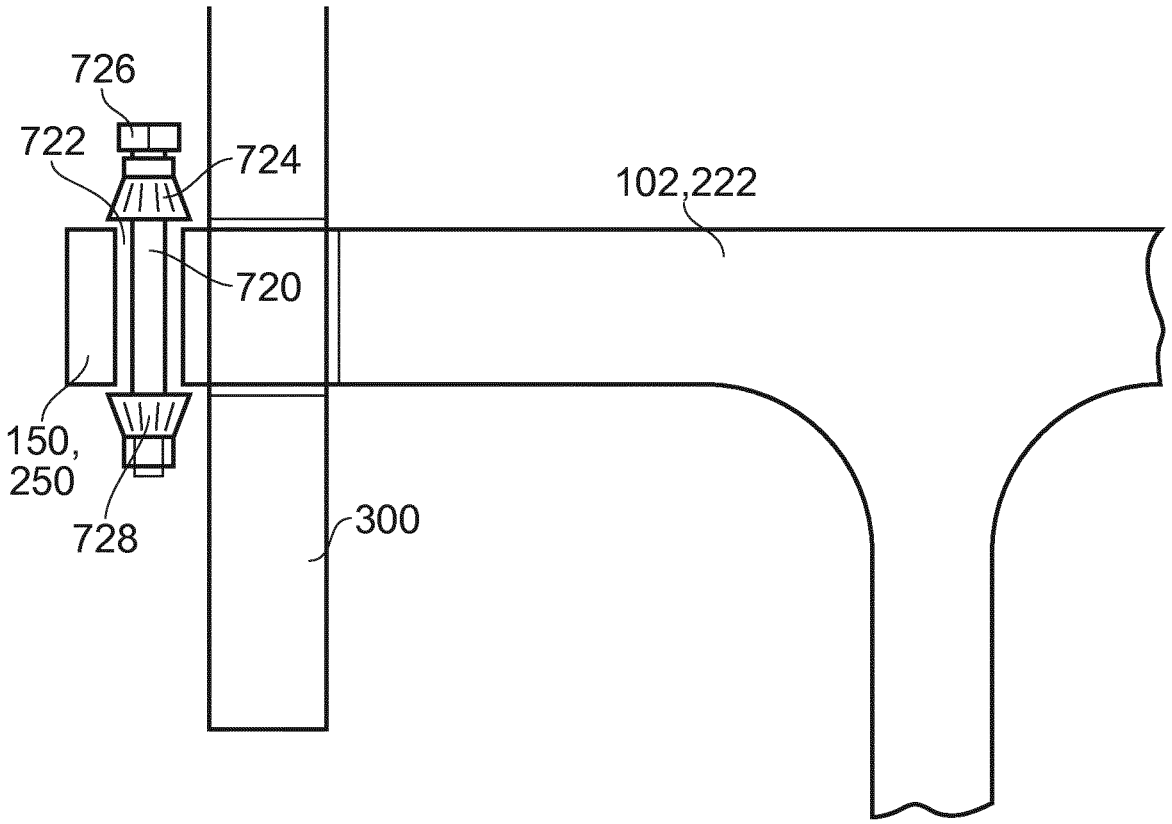
FIG. 24 shows an alternative locking arrangement for a structural assembly according to the present disclosure.
Figure 25:
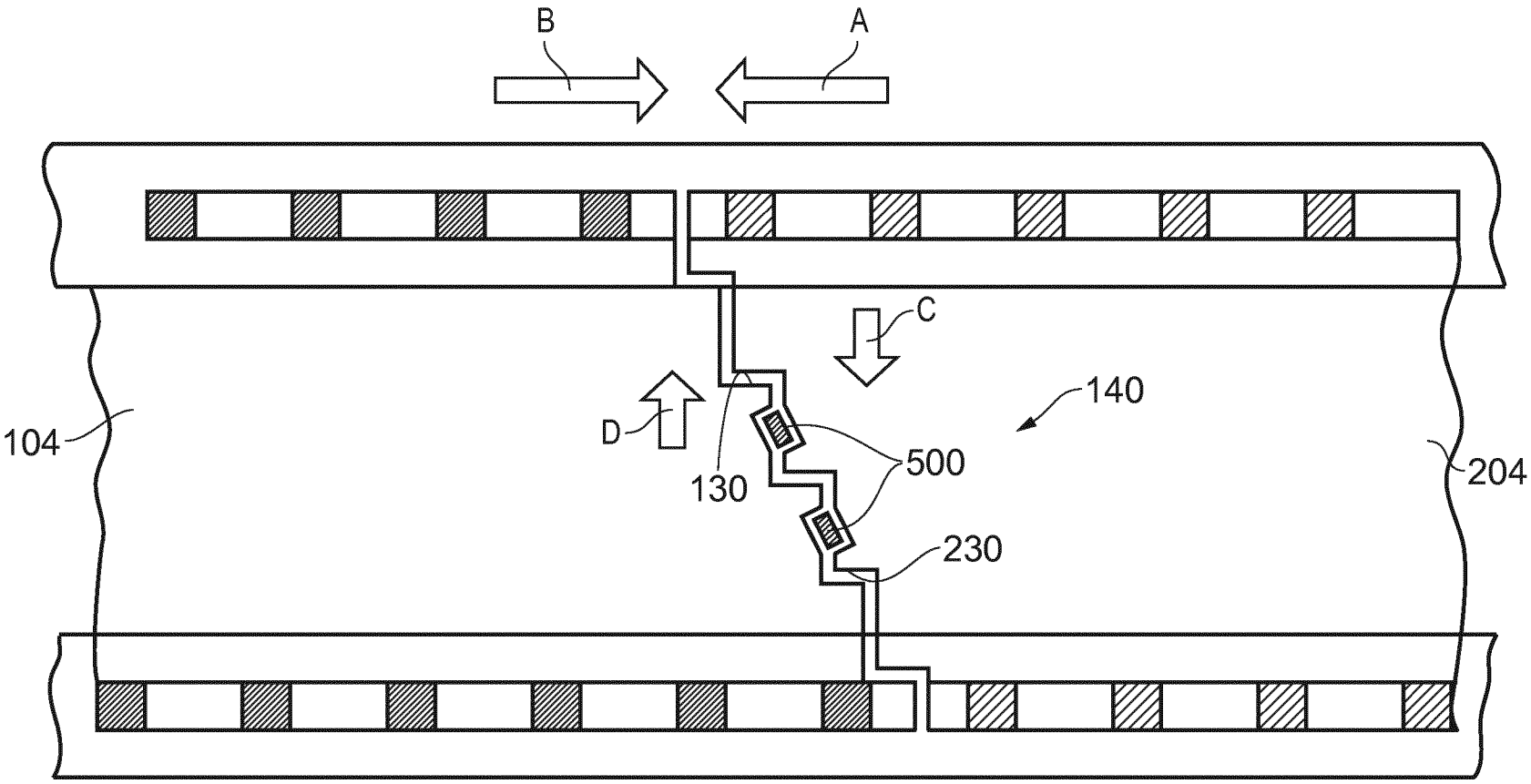
FIGS. 25 to 28 show features of an example of a further locking arrangement according to the present disclosure.
Figure 26:
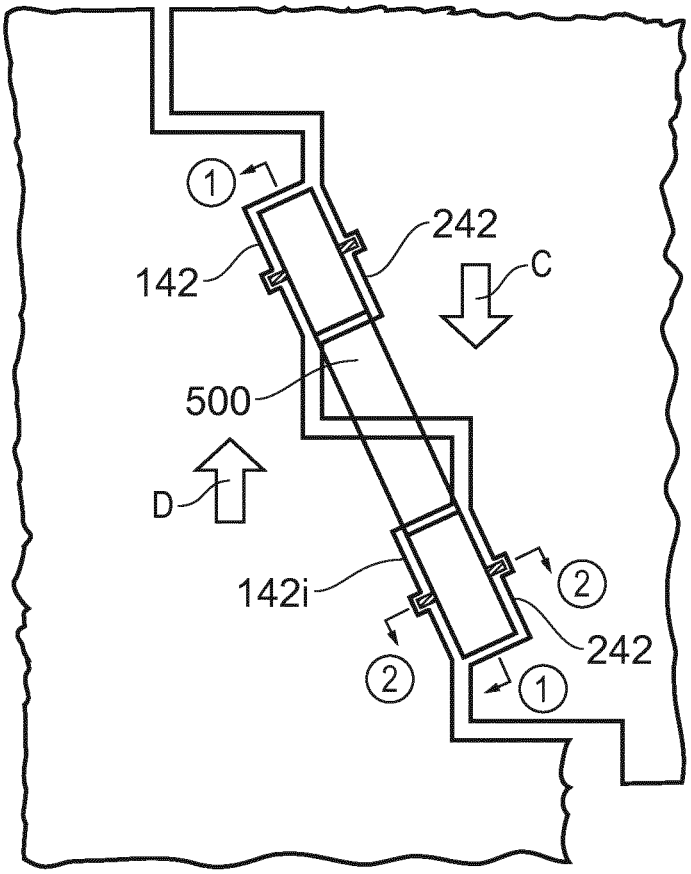
Figure 27:
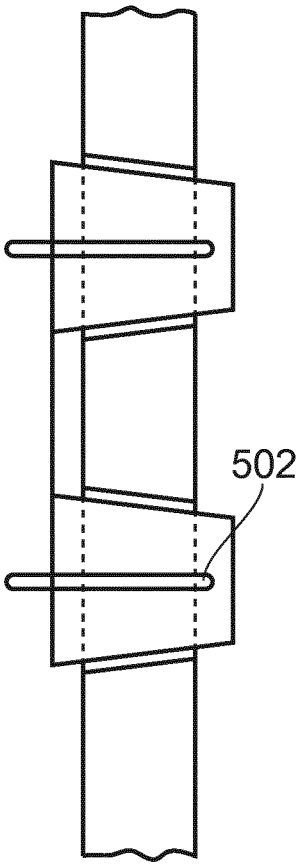
Figure 28:
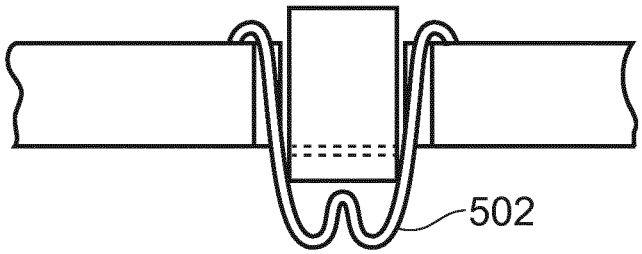

In the example shown in FIG. 24 an alternative means for holding the lock plate in position is shown. A locking element 720 passes through a passage 722 in at least one each of the fingers 150, 250 of the first and second structural members respectively. A spring washer 724 is provided between a head 726 of the locking element 720 and the finger 150, 250 such that as the locking element 720 is compressed (for example screwed tight by tightening a nut 728 on the end of the locking element 720 distal to the head 726), the spring washer 724 is forced out flat and presses against the lock plate 300 to urge the lock plate towards the first portion 102, 202.

FIGS. 25 to 28 show a further alternative example of a locking arrangement. In this example the locking feature 140 comprises a locking slot in the second portion 103, 203 for receiving a locking element 500. In this example the locking element 500 is configured to extend between the structural member locking slots 142, 242 in each structural member. The locking slots 142, 242 are provided between the stepped seating lands 130, 230 in the example shown. Hence this example is only appropriate to examples such as shown in FIG. 2.

Hence the locking element is in the form of a U shaped plate. The locking element 500 is secured in position by a spring pin 502.

Although the structural assembly is described in terms of a first and second structural member and lock plate which are assembled together, it will also be appreciated that the present disclosure relates to the individual elements of the structural assembly. That is to say there may be provided a structural member 100, 200 for a structural assembly 10, the first structural member configured for engagement with a second structural member 200 via a lock plate 300. The first structural member 100 may have a first portion 102 which extends in a first plane; a second portion 103 which extends away from the first portion 102, and which extends in a second plane at an angle to the first plane. The first portion 102 of the first structural member 100 may be provided with an engagement feature 104 configured to interlock with a compatible engagement feature 304 provided on the lock plate 300. The second portion 103 of the first structural member 100 may be provided with seating features 106 configured to seat compatible seating features 206 of the second structural member 200 to seat one of the structural members 200 on the other structural member 100.

In each example the structural assembly 10 may be assembled by locating and supporting one of the structural members on the seating features of the other. The side plates (lock plates 300) are then attached to the sides of the top and bottom flanges (first portions) of both structural members. The parts are then adjusted relative to each other and locked in place by small mechanical locks, if provided.

That is to say site assembly requires the following steps:

a. bringing the structural members/beams together;

b. connecting the side plates (lock plates 300); and c. adjusting and locking the structural members together.

Additionally the structural assembly can be disassembled in three steps, namely:

a. unlocking the lock plates 300;

b. removing the lock plates 300; and c. separating the structural members 100, 200.

In the examples shown, the second structural beam 200 is supported by the first structural member 100 via the seating features 106, 206. That is to say loads in the C-D direction of the second plane are transferred from the second structural member to the first structural member by the seating features 106, 206. Loads in the first direction A-B of the first plane are transmitted via the lock plates 300. Loads in the second direction E-F of the first plane are transferred by the end face locking features 108, 208 where present.

The structural beams may be arranged at any angle relative to one another, although may be aligned in a horizontal direction (for example as suggested in the examples of FIGS. 1 to 4), aligned in a substantially vertical direction as shown in FIGS. 7 to 11, or at an angle to one another as shown in the example of FIG. 13.

Hence there is provided an arrangement for a structural assembly which may provide a robust, secure and/or adjustable connection between structural members without bolting, riveting or welding. As described above the beams may be connected to each other by means of side plates (lock plates 300) that have holes matching corresponding fingers 150, 250 in the flanges of the structural members 100, 200. The beam webs 103, 203 are connected together by a series of matching seats in the webs of the two beams. The flange fingers and web seats are made by precise cutting of these parts, and the plate holes may be made by the same method.

Put another way, the system of the present disclosure provides a robust, secure, scalable, and dismountable connection applicable for structural and non-structural members of various sizes, geometries, and materials without screwing, bolting, riveting or welding.

The system can be used for a range of sizes and materials when connecting to similar and dissimilar materials for members that are open (e.g. I-beams, channels, and angles).

The invention is applicable to all load and non-load carrying connections between members such as in building structures, scaffolding, temporary structures, fencing, furniture, toys, set and stage elements, and sports equipment. It may be used with a range of materials (metal, wood, plastic) in a variety of orientations.

Thus, the present invention may effectively replace or supplement conventional joining mechanisms (for example weld, bolts, rivets, screws, glue).

The arrangement of the present disclosure creates a robust interlocking connection between structural members with minimal manual operations. The interlocked connection transfers forces from one member to the other through bearing on many precisely shaped and co-operating faces.

For both construction assembly and disassembly, the steps are straightforward and fast to execute. The simplicity of the connection and disconnection of the arrangement of the present disclosure is considerably simpler than with conventional methods, for example welding. Hence, structures may be assembled erected and disassembled without the need for highly trained personnel.

Consequently, an arrangement of the present disclosure is less expensive and quicker than an arrangement of the present art to assemble and/or disassemble.

Hence structural assemblies may be assembled faster and in examples of the related art, thereby saving labour and crane hook time.

The system allows for easy geometric adjustment to facilitate site construction tolerances.

Additionally, the resultant quality of the structural assembly is better than in the examples of the related art as the number of manual operations is reduced.

Further, separating the connected parts at a future time for re-use or recycling is much easier than with examples of the related art.

Also, the connection components of the present disclosure can be simplified to be cut using a simple flat-bed laser, plasma or water jet cutter. This method of cutting is significantly easier than using more sophisticated robotic cutters as may otherwise be required for precision cutting of structural members for joining.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A first structural member (100, 200) for a structural assembly (10), the first structural member configured for engagement with a second structural member (200) via a lock plate (300);

the first structural member (100) extending in a longitudinal direction and having:

a first portion (102) which extends along the longitudinal direction in a first plane;

a second portion (103) which extends away from the first portion (102) and which extends along the longitudinal direction in a second plane at an angle to the first plane;

the first portion (102) of the first structural member (100) being provided with:

an engagement feature (104) configured to interlock with a compatible engagement feature (304) provided on the lock plate (300), wherein the engagement feature (104) is provided as a tooth member (150) which extends from a longitudinal edge of the first portion (102), the tooth member (150) and the first structural member (100) being integrally formed out of a single piece of material; and the second portion (103) of the first structural member (100) being provided on a longitudinal end face with:

seating features (106) configured to seat compatible seating feature (206) of the second structural member (200) to seat one of the structural members (200, 100) on the other structural member (100, 200) such that the longitudinal direction of the first structural member (100) is aligned with or at an angle to a longitudinal direction of the second structural member (200).

2. A structural assembly (10) comprising:

a first structural member (100), a second structural member (200), and a lock plate (300);

each of the first structural member (100) and the second structural member (200) extending along a longitudinal direction and having:

a first portion (102, 202) which extends along the longitudinal direction in a first plane;

a second portion (103, 203) which extends away from the first portion (102, 202) and which extends along the longitudinal direction in a second plane at an angle to the first plane;

the first portion (102, 202) of the first structural member (100) and second structural member (200) being provided with:

an engagement feature (102, 204) configured to interlock with a compatible engagement feature (304) provided on the lock plate (300) of the structural assembly, wherein the engagement feature (104, 204) of each structural member (100, 200) is provided as a tooth member (150, 250) which extends from a longitudinal edge of the first portion (102, 202), the tooth members (150, 250) and each structural member (100, 200) being integrally formed out of a respective single piece of material; and the second portion (103, 203) of the first structural member (100) and second structural member (200) being provided on a longitudinal end face with:

compatible seating features (106, 206) configured to seat one of the structural members (200, 100) on the other structural member (100, 200) such that the longitudinal directions of the structural members (100, 200) are aligned.

3. A structural assembly (10) as claimed in claim 1 wherein the engagement feature (304) of the lock plate (300) comprises a first structural member aperture (350) and a second structural member aperture (352)

for receiving tooth members (150, 250) of respective structural members (100, 200)

such that the structural members (100, 200) are prevented from moving relative to each other in the first plane.

4. A structural assembly (10) as claimed in claim 3 wherein the tooth member (150, 250) extends at an angle away from the longitudinal edge of the first portion (102, 202)

in a direction away from a proximate end (107, 207) of the respective structural member (100, 200) of the tooth member (150, 250).

5. A structural assembly (10) as claimed in claim 3 wherein the tooth member (150, 250) tapers as the tooth member (150, 250) extends away from the longitudinal edge of the first portion (102, 202).

6. A structural assembly (10) as claimed in claim 3 wherein a plurality of tooth members (150, 250) are provided in series at one end of the first portion (102, 202) of each of the structural members (100, 200).

7. A structural assembly (10) as claimed in claim 3 wherein each structural member (100, 200) comprises a third portion (160, 260) which extends from the second portion (103, 203) in a third plane, the third portion (160, 260) of the first structural member (100) and second structural member (200) being provided with:

an engagement feature (164, 264) provided as a tooth member (166, 266) configured to interlock with a compatible engagement feature (304) provided on the lock plate (300);

the respective engagement feature (304) of the lock plate (300) comprises further apertures (350, 352)

for receiving the third portion tooth members (150, 250) of each structural member (100, 200)

such that the lock plate (300) extends between the first portion (102, 202) and third portion (160, 260) of each of the structural members (100, 200).

8. A structural assembly (10) for a structural assembly as claimed in claim 2 wherein the compatible seating features (106, 206) comprise a series of compatible interlocking fingers (110, 210).

9. A structural assembly (10) for a structural assembly as claimed in claim 2 wherein the seating features (106, 206) of each structural member (100, 200) each comprise a seating land (130, 230) compatible with the seating land (130, 230) on the other structural member (100, 200).

10. A structural assembly (10) as claimed in claim 9 wherein the seating land (130, 230) is provided on a step (132, 232), the step (132, 232) extending in a direction (C-D) of the second plane, and the step being offset from the first plane.

11. A structural assembly (10) as claimed in claim 9 wherein the seating feature (106, 206) of each structural member (100, 200) comprises a series of stepped seating lands (130, 230) which seat a compatible series of stepped lands (130, 230) on the other structural member (100, 200).

12. A structural assembly (10) as claimed in claim 9 wherein the second portion (103, 203) of each structural member (100, 200) comprises a locking feature (140, 240) configured to prevent the seating features (106, 206) of the structural members from becoming disengaged by moving past each other in the direction of the second plane.

13. A structural assembly (10) as claimed in claim 12 wherein:

the locking feature (140) comprises a locking slot (142, 242) in the second portion (103, 203) for receiving a locking element (500) configured to extend between the structural member locking slots (142, 242) in each structural member.

14. A structural assembly (10) as claimed in claim 13 wherein:

the locking slots (142, 242) are provided between the seating lands (130, 230).

15. A structural assembly (10) for a structural assembly as claimed in claim 2 wherein:

the first portion (102, 202) of the first structural member (100) and second structural member (200) are provided with:

an end locking feature (108, 208)

for locking engagement with each other to thereby prevent the end locking features (108, 208) from becoming disengaged by moving past each other in the first plane, and configured such that the seating features (106, 206) on the second portion (103, 203) of the first structural member (100) and second structural member (200)

prevent the end locking engagement features (108, 208) from becoming disengaged by moving past each other of the second plane.

16. A structural assembly (10) as claimed in claim 15 wherein the structural member end locking features (108, 208) comprise:

a tooth member (120, 220) which extends away from an end of the first portion (102, 202) of one of the structural members (100, 200) for interlocking engagement with a compatible slot (122, 222) in the end of the first portion (102, 202) of the other of the structural members (100, 200).

17. A structural assembly (10) as claimed in claim 15 wherein the end locking features (108, 208) comprise:

a compatible slot (122, 222) for interlocking engagement with a key member (400).

18. A structural assembly (10) as claimed in claim 15 wherein the end locking features (108) on the first structural member (100) is engageable with the compatible end locking feature (208) provided on the second structural member (200) in the first direction (C-D) of the second plane; and the seating features (106) on the first structural member (100) is engageable with the compatible seating feature (206) provided on the second structural member (200) in the first direction (C-D) of the second plane.

19. A structural assembly (10) as claimed in claim 2 wherein the first plane is at right angles to the second plane.

* * * * *